United States Patent [19]

Pacelli

[11] Patent Number: 5,001,788

[45] **Date of Patent: * Mar. 26, 1991**

[54] PORTABLE PERITONEAL WASTE DISCHARGE SYSTEM

[76] Inventor: Alfonso M. Pacelli, 303 Boulevard Dr., Wayne, N.J. 07470

[ * ] Notice: The portion of the term of this patent subsequent to Aug. 30, 2005 has been disclaimed.

[21] Appl. No.: 341,400

[22] Filed: Apr. 21, 1989

[51] Int. Cl.[5] ..... A47K 17/00

[52] U.S. Cl. ..... 4/661

[58] Field of Search ..... 4/661, 441

[56] References Cited

U.S. PATENT DOCUMENTS

| | | | |
|---|---|---|---|
| 2,568,857 | 9/1951 | Jacobs | 4/239 |
| 3,210,141 | 10/1965 | Thomas | 312/228 X |
| 4,285,076 | 8/1981 | Dickstein | 4/341 |
| 4,345,343 | 8/1982 | Shipman | 4/661 X |
| 4,766,622 | 8/1988 | Pacelli | 4/661 |

*Primary Examiner*—Charles E. Phillips

*Attorney, Agent, or Firm*—M. K. Silverman

[57] ABSTRACT

A portable waste container discharge system, for use in combination with a toilet, includes a housing; a disinfectant storage chamber formed within the housing; a multi-port valve in selectable fluid communication with the multiport valve in which selectable positioning of the valve will fill the measuring chamber with disinfectant from the storage chamber; an element for suspending a body fluid bag in a vertical, gravity-drain position, the element attached to the housing; and a discharge block in fluid communication with an output of the body fluid bag, the block also in fluid communication with the multi-port valve for fluid communication with the measuring chamber, in which the valve may selectively block fluid communication between the storage chamber and the discharge block, or between the measuring chamber and the discharge block, and selectively enable passage of disinfectant from the measuring chamber to the discharge block, and thereby to the toilet.

1 Claim, 5 Drawing Sheets

PORTABLE PERITONEAL WASTE DISCHARGE SYSTEM

BACKGROUND OF THE INVENTION

The instant invention is an improvement of my earlier invention embodied in U.S. Pat. No. 4,766,622 (1988), entitled Peritoneal Waste Discharge System.

My above invention, and other systems known in the art, are not portable in the sense that a permanent installation in the area of a toilet is required to practice inventions of such type. The instant invention employs the principles of my previous patent but, however, employs such principles in the context of a portable unit which may, be transported, as desired, for use in another or different toilet location.

Prior art efforts in portable peritoneal discharge systems had embodied systems not as convenient and sanitary as would be desired in a hospital or clinical setting. For example, U.S. Pat. No. 4,285,076 (1981) to Dickstein, requires the use of rubber gloves, while the system of U.S. Pat. No. 2,568,857 (1951) to Jacobs requires that the individual using such a system, for example a nurse, must empty the peritoneal waste bag manually. Certain prior art, such as that reflected in U.S. Pat. No. 4,345,343(1982) to Shipman, is appropriate only for hospital use and as such cannot be applied in the home area. The instant invention is equally convenient for use in a home, nursing home, hospital, or other clinical setting and is equally easily usable by both trained and non-trained personnel.

SUMMARY OF THE INVENTION

The present invention provides for a portable peritoneal waste discharge system having a disinfectant storage chamber, a measuring chamber in selective fluid contact therewith, a peritoneal bag vertically oriented substantially parallel with said measuring chamber, a multi-port valve for selectably filling said measuring chamber with disinfectant and emptying said chamber and valve means for selectively emptying said storage chamber into a conduit common to an exit region from the peritoneal bag, said exit region being a flexible conduit input from said peritoneal bag to the inside base of the bowl of a toilet which is kept as a horizontal level below that of the portable waste discharge system.

The inventive apparatus permits the simultaneous mixing of disinfectant, such as bleach, with the contents of a peritoneal bag such that, through suitable valve means, the solution of waste material and disinfectant may be disposed of within a conventional toilet, simply upon depressing of the flush handle of the toilet.

It is another object of the invention to provide a convenient, sterile method of disposing of peritoneal and related waste stored within a body fluid bag.

It is another object to provide an improved, home care flushing system for use with peritoneal and related waste bags.

It is a further object to provide a means of the above type requiring a minimum of handling and potential contamination to a user during the course of home care.

It is yet further object to provide assist to the above type which is portable and is suitable for use either within a hospital or home care environment.

The above and other objects and advantageous of the present invention will become apparent from the herein after set forth Detailed Description of The invention, the Claims and the Drawings included herewith.

BRIEF DESCRIPTION OF THE DRAWINGS

FIG. 3 is a cross sectional view taken along Line 3—3 of FIG. 2.

DETAILED DESCRIPTION OF THE INVENTION

Figure 1:
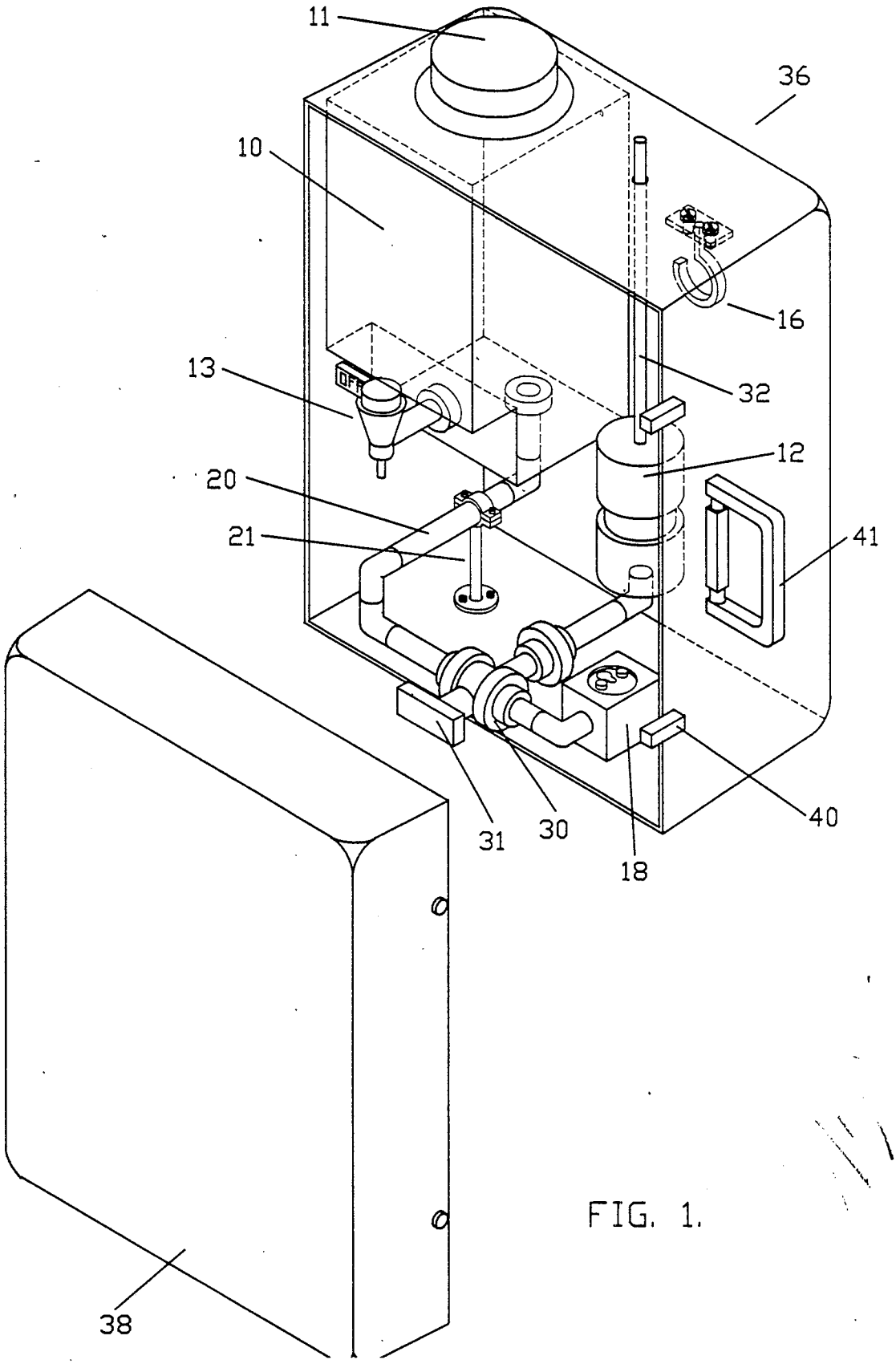
FIG. 1 is a perspective view showing the portable waste discharge system with the cover thereof removed.
Figure 2:
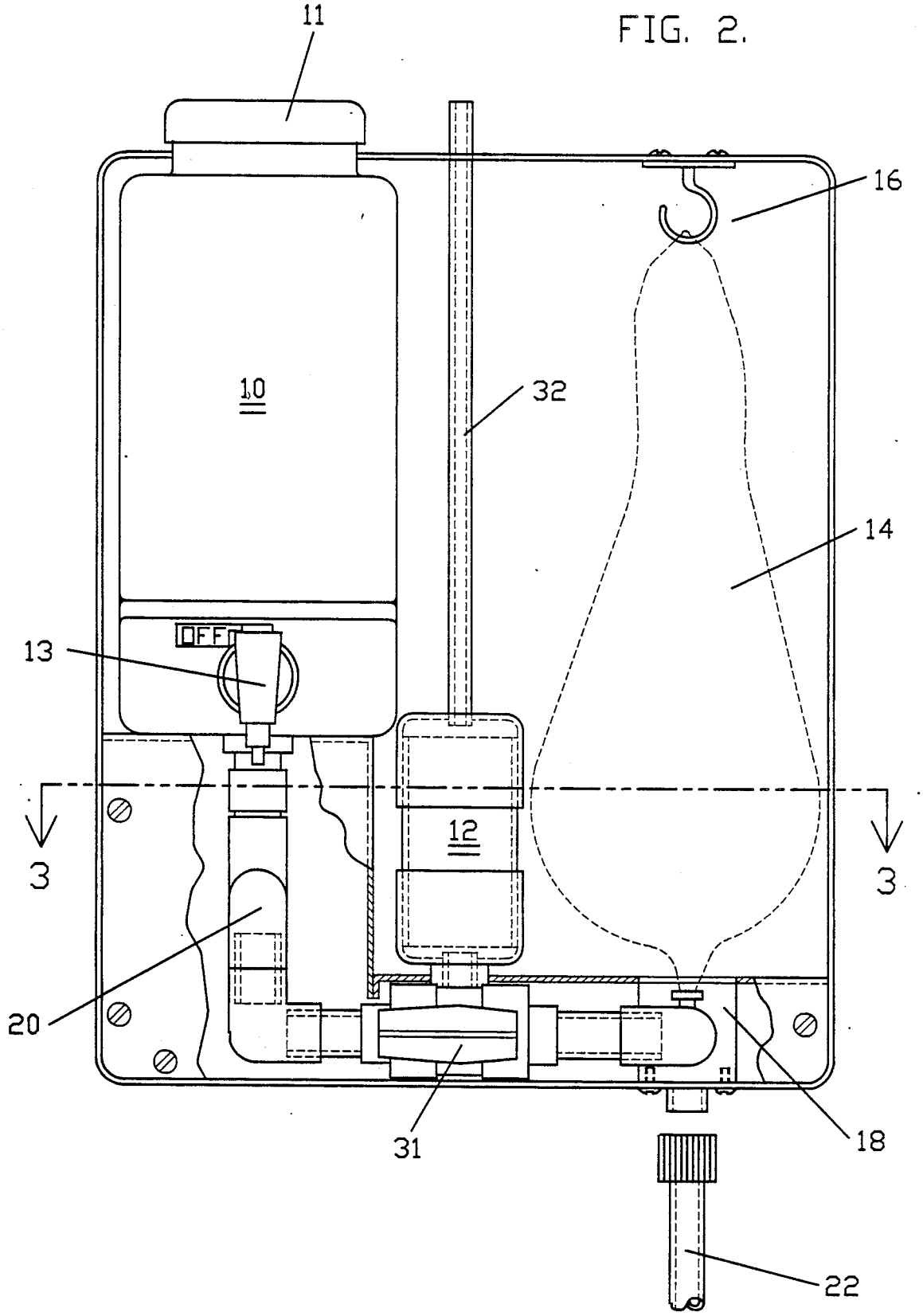
Figure 3:
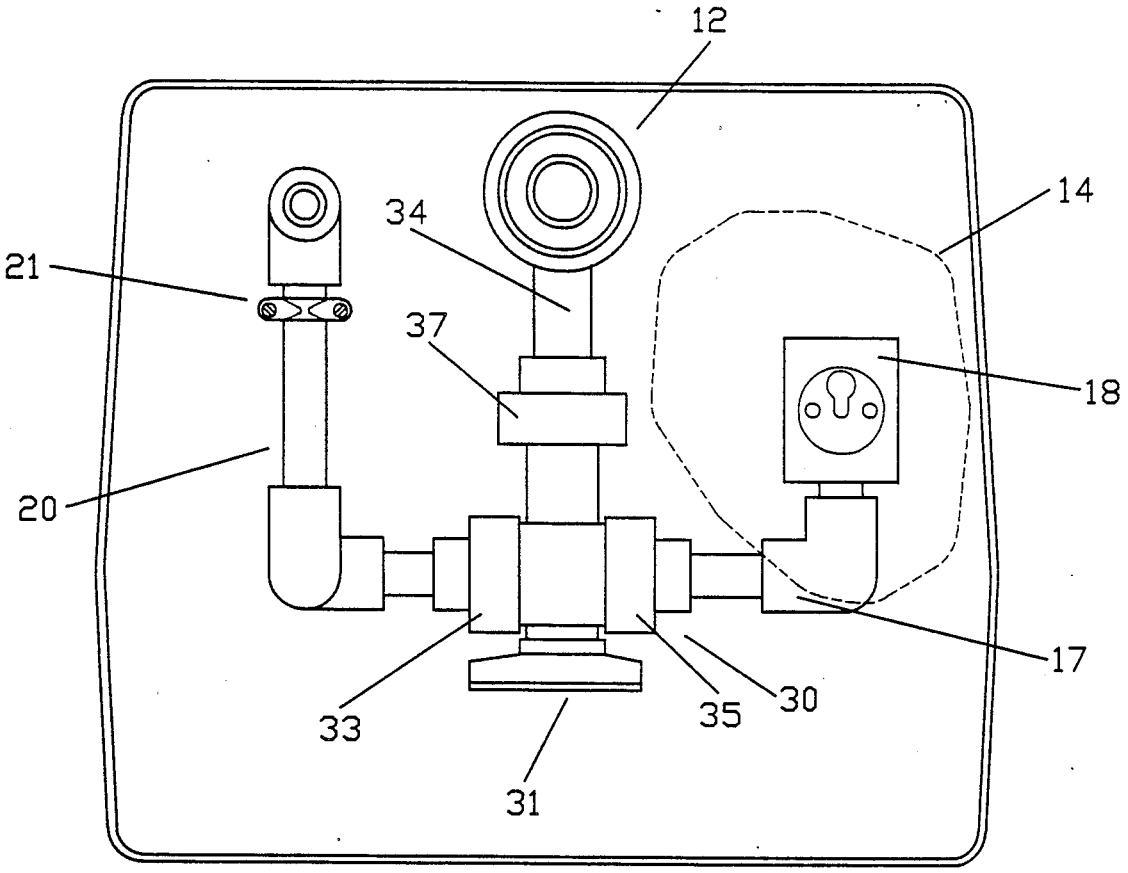
Figure 4:
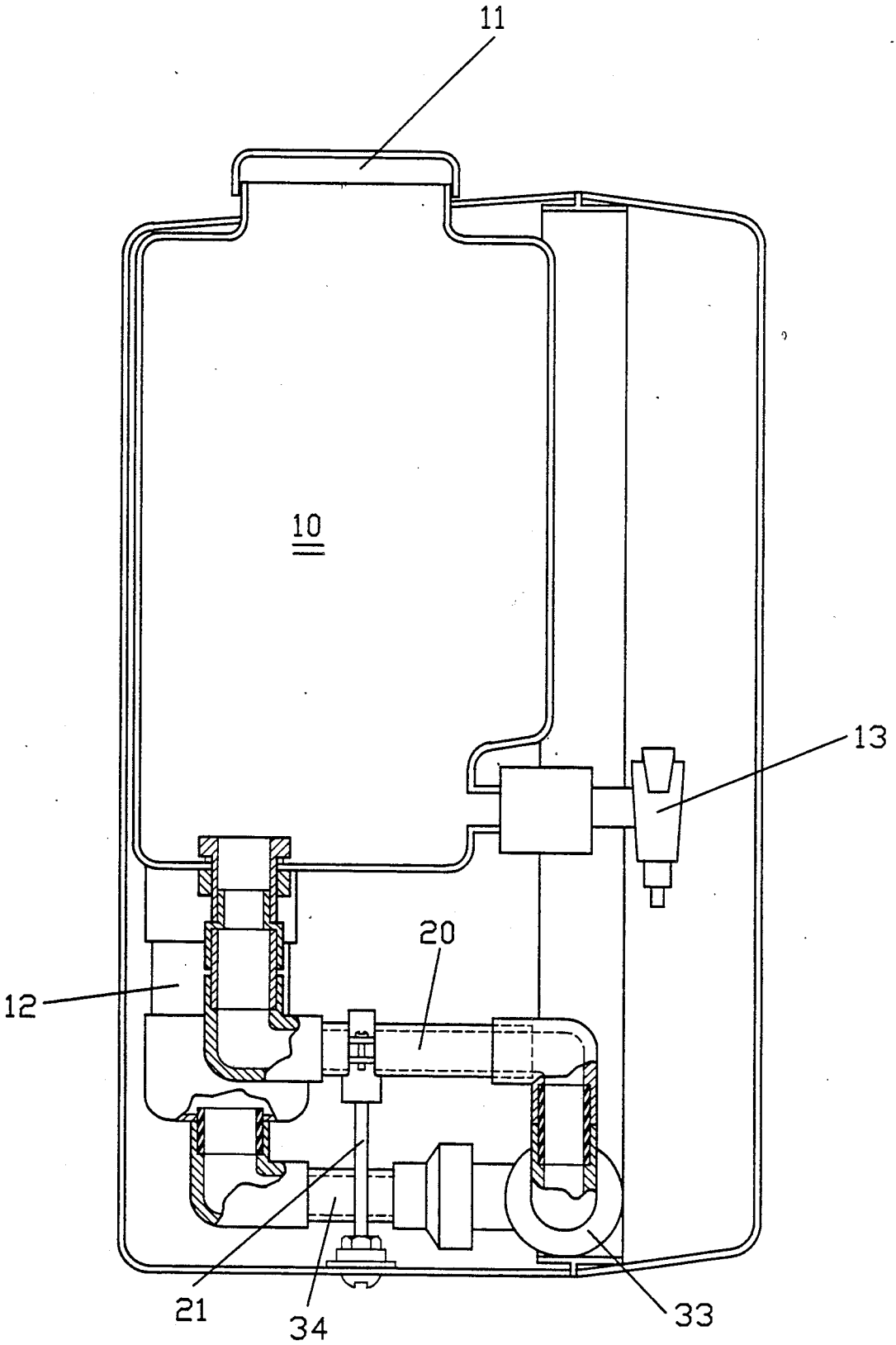

With reference to the perspective view of FIG. 1, the inventive portable peritoneal waste discharge system is seen to include a storage chamber 10 having a filling area 11 and spicket 13 which is employed when one wishes to drain the chamber 13.

In fluid communication with disinfectant storage chamber 10 is conduit 20 which communicates with a multi-port ball valve 30. Valve 30 has two functions. The first is to provide for the filling of measuring chamber 12 which function occurs when handle 31 of valve 30 is turned to the left, which is the position shown in the figures. Therein junction 33 is opened and junction 35 is blocked. When handle 31 is turned to the right, junction 33 is blocked, and junctions 35 and 37 are opened, enabling disinfectant to flow through elbow 17 and into discharge block 18.

Figure 2:
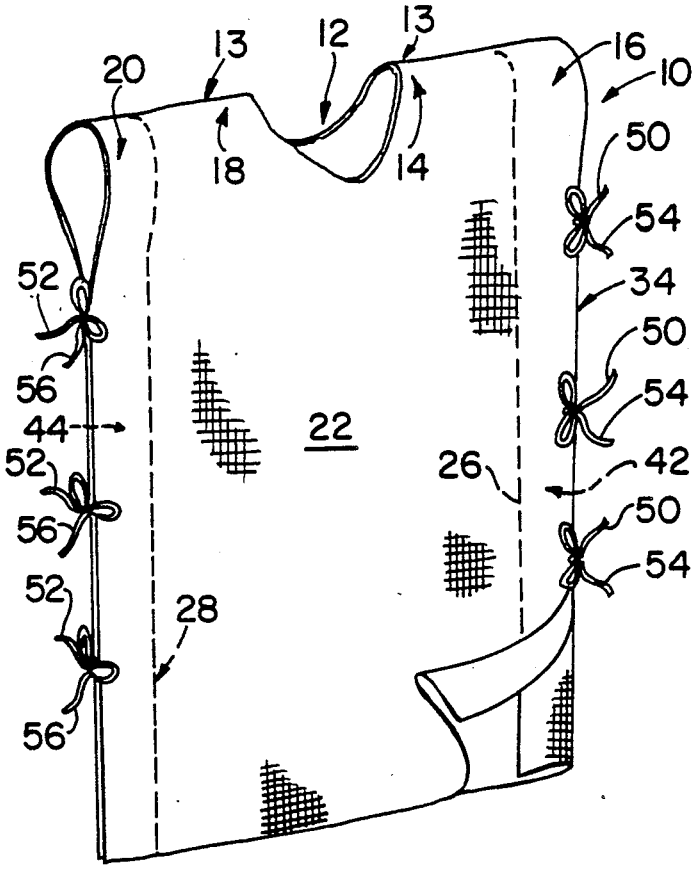
FIG. 2 is a front plan view of the operative components of the inventive system.
Figure 3:
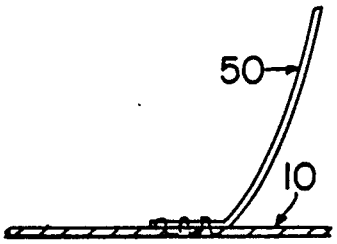
FIG. 3 is a cross sectional view of the operative components of the inventive system.
Figure 4:
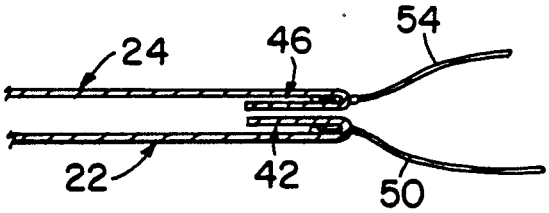
FIG. 4 is a left side view of the inventive system.
Figure 5:
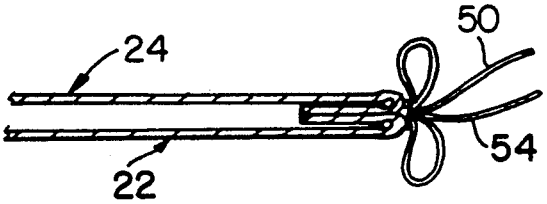
FIG. 5 is an operational view showing the portable waste discharge system employed in connection with a toilet.
Figure 6:
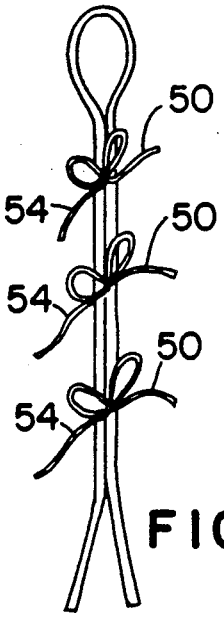

As may be noted in the views of FIGS. 2 and 5, a discharge bag 14 hangs upon hook 16 and exits into discharge block 18. Accordingly, both the contents of disinfectant measuring chamber 12 and the contents of discharge bag 14 exit the housing 36 through discharge block 18 and, therefrom, enter conduit 22 which, as shown in the views FIGS. 2 and 5, flows from a higher level to a lower level and into toilet bowl 24 whereby, upon actuation of flush handle 26, the combined discharge of the system is passed into the sewerage system.

It is further noted that discharge chamber 12 is provided with a vent line 32 and, further, housing 36 is provided with a covering door 38 which is connected to said housing 36 by clasps 40. Housing 36 also provided with a handle 41 to permit ease of transport of the portable system.

In summary, it is to be understood that when valve handle 31 is turned in the direction of disinfectant storage chamber 10, the pathway to discharge block 18 is closed thereby preventing any flow of disinfectant from disinfectant chamber 12 to discharge block 18. Conversely, when handle 31 is turned in the direction opposite the storage chamber 10, disinfectant is permitted to flow into discharge block 18, the input of which mates with the mouth of bag 14 in block 18.

Accordingly, while there has been shown described, the preferred embodiment of the present invention, it will be understood that the invention may be embodied otherwise then is here and specifically illustrate or described and that, in such embodiments, surchanges in the detail and construction, and the form and arrangement of the parts may be made without departing from the underlying ideal or principles of this invention within the scope of the appended claims.

Having thus described my invention what I claim as new, useful and nonobvious and, accordingly, secure by Letters Patent of the United States is:

1. A portable waste container discharge system, for use in combination with the toilet, the system comprising:

(a) a housing;

(b) a disinfectant storage chamber formed within the said housing;

(c) a multi-port valve in selectable fluid communication with said chamber;

(d) a measuring chamber in selectable fluid communication with said multiport valve in which selectable positioning of said valve will fill said measuring chamber with disinfectant from said storage chamber;

(e) means for suspending a body fluid bag in a vertical, gravity-drain position, said means attached to said housing; and (f) a discharge block in fluid communication with an output of said body fluid bag, said block, also in fluid communication with said multi-port valve for fluid communication with said measuring chamber, in which said valve may selectively block fluid communication between said storage chamber and said discharge block, and between said measuring chamber and said discharge block, and or selectively enable passage of disinfectant from said measuring chamber to said discharge block, and thereby to said toilet.

* * * * *